United States Patent [19]

Wilkes

[11] Patent Number: 4,819,005

[45] Date of Patent: Apr. 4, 1989

[54] CONCENTRIC WAVEGUIDES FOR A DUAL-BAND FEED SYSTEM

[76] Inventor: Brian J. Wilkes, 1015 Thomas Rd., Leesburg, Fla. 32748

[21] Appl. No.: 898,486

[22] Filed: Aug. 21, 1986

[51] Int. Cl.[4] ..... H01Q 13/00

[52] U.S. Cl. ..... 343/786; 343/776

[58] Field of Search ..... 343/786, 772, 776

[56] References Cited

U.S. PATENT DOCUMENTS

| | | | |
|---|---|---|---|
| 3,324,423 | 6/1967 | Webb | 343/786 |
| 3,325,817 | 6/1967 | Ajioka et al. | 343/786 |
| 3,508,277 | 4/1970 | Ware et al. | 343/786 |
| 3,566,309 | 2/1971 | Ajioka | 343/786 |
| 3,665,481 | 5/1972 | Low et al. | 343/786 |
| 3,864,687 | 2/1975 | Walters et al. | 343/786 |
| 4,041,499 | 8/1977 | Liu et al. | 343/786 |
| 4,442,437 | 4/1984 | Chu et al. | 343/786 |

*Primary Examiner*—William L. Sikes
*Assistant Examiner*—Hoanganh Le
*Attorney, Agent, or Firm*—Macdonald J. Wiggins

[57] ABSTRACT

A dual-band linear cross-polarized antenna waveguide comprising a coaxial pair of waveguides, with the higher frequency band waveguide contained completely within the $TE_{01}$ mode null of the lower frequency band. The lower frequency waveguide completely surrounds and is concentric to the higher frequency waveguide.

5 Claims, 2 Drawing Sheets

CONCENTRIC WAVEGUIDES FOR A DUAL-BAND FEED SYSTEM

BACKGROUND OF THE INVENTION

Presently, communications between land-based systems and earth-orbiting satellites are basically conducted in the C and Ku frequency bands. Consequently, any land-based station which communicates with satellites utilizing either of these two frequency bands would require two different antennas, a feed system wherein the C band feed is offset several beam widths from the bore site of a parabolic antenna and a Ku band feed system upon the bore site of the antenna. Alternatively, the Ku band feed could be offset a plurality of band widths from the bore site and the C band feed provided on the bore site. In either situation, two antennas, as well as two distinct feed systems, must be utilized.

The prior art, in order to save space and money, has proposed utilizing a single dual-beam feed in conjunction with a single parabolic antenna. One such device is described in U.S. Pat. No. 3,665,481 to Low et al. This patent illustrates a multi-purpose antenna employing a dish reflector having plural coaxial horn feeds. The waveguide assembly would include a circular inner tube 16 transmitting an X-band signal of approximately 8.44 GHz, an intermediate tube 18 more than twice the diameter of the inner tube for transmitting an S-band signal of approximately 2.295 GHz, and an outer tube 20 for receiving an S-band signal of a frequency of approximately 2.115 GHz. As shown in FIG. 1 of the Low patent, the low frequency (S-band) waveguide utilizes one conical horn to illuminate the antenna, and the high frequency (X-band) waveguide employs a second conical horn to illuminate the reflector which would block a portion of the radiation of the lower frequency S-band, thereby reducing aperture illumination of the lower frequency band.

The problems caused by this configuration are illustrated in FIG. 1 of the present invention which shows the prior art Low patent. As shown therein, the X-band source of radiation 10 is transmitted through a circular waveguide 16, and the S-band source 12 is transmitted through a circular waveguide 14 which completely surrounds the inner circular waveguide and is concentric with respect to this inner circular waveguide. Since the inner waveguide 16 employs a conical cone 18 and the outer waveguide 14 also utilizes a second conical horn, the conical horn 18 of the inner waveguide 16 reduces the radiation of the outer waveguide 14 and reflects the S-band signal back in the outer waveguide 14, causing the voltage standing wave ratio (VSWR) to be degraded, as shown by the arrow provided in this Figure. While ideally the VSWR of a waveguide should be 1.0, the utilization of the conical horns 18 and 20 of the Low patent might produce an unacceptable VSWR in the range of 1.8 or greater.

U.S. Pat. No. 3,864,687 issued to Walters et al describes a coaxial horn antenna provided with three cylindrical horns 12, 14 and 16 which are progressively sized to provide an inner radiating aperture 18, a concentric intermediate aperture 20 and a concentric outer aperture 22 at the front end of the antenna. The beam width of the frequencies transmitted within these waveguides are controlled by staggering the forward ends of the horns, with the inner horn projecting furthest, the staggering also adding to the isolation. Beam width is reduced as the stagger is increased and can be set to specific characteristics. Although this patent describes a coaxial horn antenna provided with a plurality of waveguides, no recitation is included therein nor is described or suggested by the patent to Low which would optimize the particular geometry of the waveguides such that the diameters of the concentric waveguides would be an optimal length with respect to each other as well as with respect to the particular frequencies which are transmitted therethrough. Although the patent to Low indicated that the outer, low frequency waveguide diameter is more than twice the diameter of the inner, high frequency waveguide, the exact relationship between these two waveguides with respect to the specific frequencies transmitted therethrough has not been addressed.

SUMMARY OF THE INVENTION

The deficiencies of the prior art are overcome by the present invention which provides a coaxial, concentric dual-band feed system in which two separate bands of frequencies are transmitted and received on the same axis. Although it is contemplated that the waveguide of the present invention can be utilized to transmit as well as to receive microwave energy, for simplicity's sake, we will limit our discussion to the transmission of microwave energy.

The waveguide of the present invention employs two separate circular waveguides on the same axis with the lower frequency energy transmitted by the larger waveguide in the $TE_{01}$ mode, and the higher frequency being transmitted by the smaller waveguide provided within and concentric to the larger waveguide. The smaller waveguide is of a diameter that is contained in an envelope within the field of the lower frequency mode and is of a size such that it is contained in the null area of the lower frequency waveguide where there is no current flow in the $TE_{01}$ mode. The higher frequency waveguide acts as a mode filter for all the other modes at the lower frequency.

A scalar feed is provided between the antenna and the lower frequency waveguide, and the low frequency band illumination angle is determined by this scalar feed with the subtended angle matched to the focal to diameter (f/d) ratio of the parabolic antenna with which the feed will be placed. The high frequency band illumination angle is determined by the amount the inner waveguide protrudes the opening plane created by the outer waveguide without exciting higher modes in the inner or outer tubes.

Each of the two ports of each of the waveguides can be orthogonal with respect to the other and is in the same plane. In this situation, closely spaced diametric pins would be needed to obtain the proper cross-polarization. Alternatively, the ports could be in orthogonal planes and consequently, the 90° rotator comprising diametric spaced pins inside each waveguide would not be necessary.

Dual linear polarization is utilized in both bands instead of the circular polarization of the prior art, due to the increased effects of rain attenuation on the circular polarization of both bands. This polarization is accomplished by rotating a flange on either waveguide which in turn rotates each of the waveguides independently of one another.

Therefore, the present invention provides a dual frequency band linear cross-polarized waveguide that will provide maximum efficiencies in two frequency bands and will minimize the amount the lower frequency signal is reflected, caused by the interaction between the two waveguides Furthermore, the present invention would allow for the polarization to be independently controlled on both frequency planes.

This and other objects and features of the present invention will be described in more detail when read in conjunction with the accompanying drawings.

DESCRIPTION OF THE PREFERRED EMBODIMENTS

Figure 2:
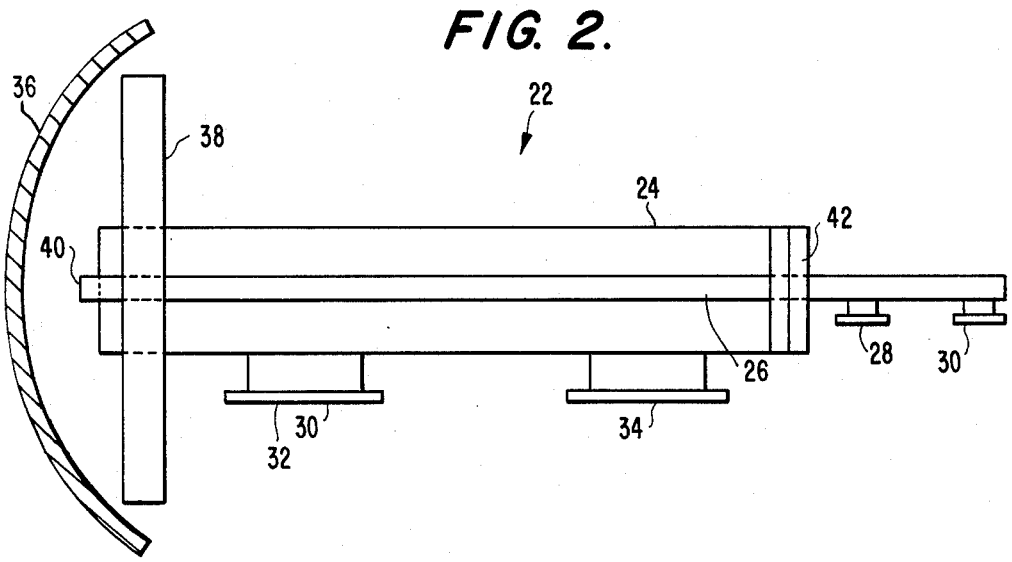
FIG. 2 is a perspective drawing of the waveguide of the present invention.
Figure 3:
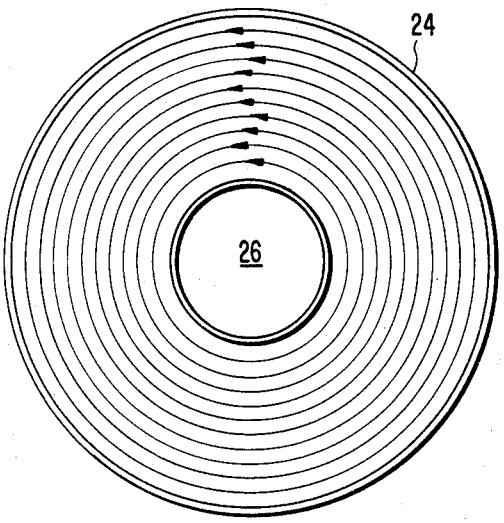
FIG. 3 is an end-view of the waveguide of the present invention showing the waveguide as well as the $TE_{01}$ mode of the higher frequency waves.

The preferred embodiment of the present invention is illustrated particularly with respect to FIGS. 2 and 3. These Figures illustrate a dual-frequency band linear cross-polarized waveguide 22 provided with a first, larger waveguide 24 for the transmission of a relatively low frequency signal, and a smaller waveguide 26 provided within the waveguide 24 and concentric therewith. This smaller waveguide 26 is designed to transmit a frequency higher than that transmitted by the waveguide 24. The vertical and horizontal signals of the lower frequency waveguide 24 are transmitted to this waveguide 24 through the use of ports 32 and 34 which are orthogonal to each other and provided in the same plane. Similarly, ports 28 and 30 provide the vertical and horizontal signals for the higher frequency waveguide 24.

It is crucial to the teachings of the present invention that the diameters of each of the waveguides 24 and 26 be calculated with respect to one another and, additionally, in conjunction with the particular frequencies which will be transmitted through each of the waveguides. More specifically, the diameter of the lower frequency waveguide 24 must be large enough to allow for the smaller waveguide 26 to be contained within the null area of the lower modes $TE_{01}$, $TM_{01}$ of the lower frequency band without degrading or reflecting transmissions or reception of the frequency band. Although the exact frequency of this lower frequency band is not important, for the purposes of the present invention, a frequency band of between 3.7 and 4.2 GHz has been utilized. Additionally, the diameter of the waveguide 24 must be small enough to contain the complete band without reaching the cut-off frequency of the 3.7 to 4.2 GHz band. Furthermore, the diameter of the lower frequency waveguide 24 must be of a size that only produces $TE_{01}$ and $TM_{01}$ modes with respect to the particular frequency being transmitted therethrough.

The diameter of the higher frequency waveguide 26 has been derived such that it is large enough to allow for the complete higher frequency band (in this situation 9.0 to 15.0 GHz) to be transmitted and received without reaching the cut-off limit. Furthermore, the diameter must be small enough to be contained within the $TE_{01}$ and $TM_{01}$ modes so as not to degrade or reflect the lower waveguide transmission or reception.

The illumination angle of the low frequency band is determined by a scalar feed 38 with respect to the antenna 36. The illumination angle is determined with the subtended angle matched to the focal to diameter (f/d) ratio of the parabolic antenna with which the feed will be placed. This aperture illumination of the lower frequency waveguide can be changed to allow various subtended angles for different f/d ratios. The lower frequency band may be adapted to various f/d ratios by changing the relation to the scalar feed network and the amount the waveguide protrudes or digresses the plane opening created by the scalar feed horn.

Illumination angles of less than 70° would mandate that the scalar be shaped like a conical horn with a plurality of concentric slots and flanges of lessening diameter as the scalar feed approaches the waveguide 24. Flat scalar feeds would be used for larger illumination angles, typically between 130° to 170°.

The angle of illumination of the higher frequency waveguide band 26 is determined by the amount the inner waveguide protrudes, at 40, the opening plane created by the outer waveguide 24 without exciting higher modes in the inner tube 26 or the outer tube 24.

Figure 1:
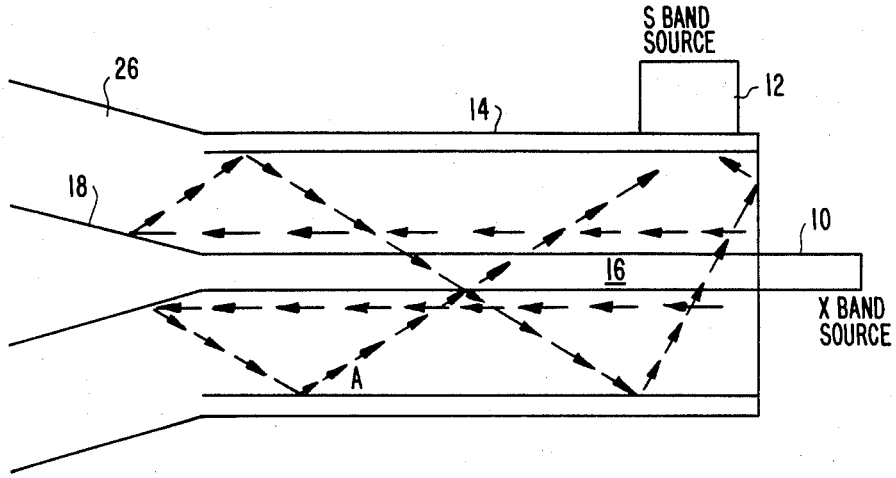
FIG. 1. (PRIOR ART)
FIG. 1 is a schematic drawing of the prior art showing the interaction of the lower frequency waves of the larger waveguide with the conical horn of the smaller waveguide.

FIG. 3 illustrates the relationship between the inner waveguide 26 and the outer waveguide 24 with respect to the null area of the lower mode $TE_{01}$ of the lower frequency band. It is noted that the circular mode $TE_{01}$ is denoted by the plurality of concentric circles of electrical waves provided between the outer surface of the inner waveguide 26 and the inner surface of the outer waveguide 24. It is important to note that no electrical waves are provided within the area within which the inner waveguide 26 is provided. Therefore, interaction between the two waveguides is reduced to a minimal level and neither frequency band is impaired or reflected from transmission or reception by either waveguide. Furthermore, the voltage standing wave ratio (VSWR) characteristics of both bands is excellent since the inner waveguide does not employ a conical horn. This feature is contrasted to the prior art shown in FIG. 1 which employs such a conical horn, and therefore the VSWR characteristics would be much greater than 1. The non-utilization of the conical horn for the inner waveguide in the present invention would mean that there is no impedance mismatch between the two waveguides.

The linear components of each of the wavebands can be independently polarized with respect to one another. This is important since the polarization of the linear components may be skewed for differences between satellites, and effects of Faraday rotation differences created by the magnetic fields of the earth that are dissimilar in both the high and low frequency bands. By rotation of flange 42, the linear polarization of the lower frequency waveband can be changed. A vane-type skew control could be utilized in this situation. This rotation moves diametrically spaced pins with a magnetic tip pivoting around the inner tube. Movement is accomplished by inducing a voltage in an external coil surrounding each pin excited by a DC voltage.

Figure 5:
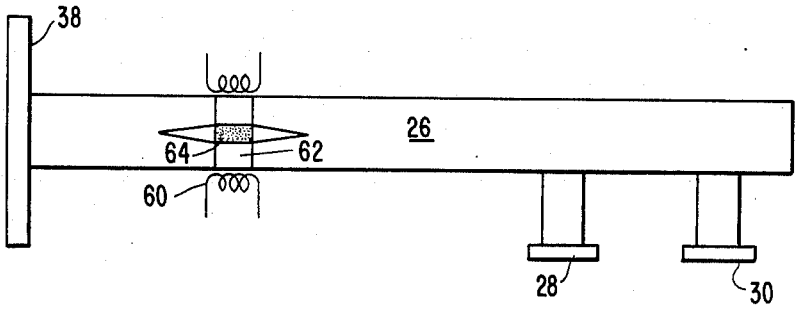
FIG. 5 is a perspective drawing of the inner waveguide of the present invention.

A Faraday rotation of the high frequency waveband by means of a suitable ferrite garnet, yttrium iron garnet, or precious stone material is used in conjunction with a coil for excitation. As depicted in FIG. 5, the high frequency polarization skew is accomplished by playing the suitable ferromagnetic material within a low loss plastic holder 62 in the high frequency waveguide 26. A coil 60 is externally wound around the waveguide 26 and movement is accomplished by exciting the coil.

Figure 4:
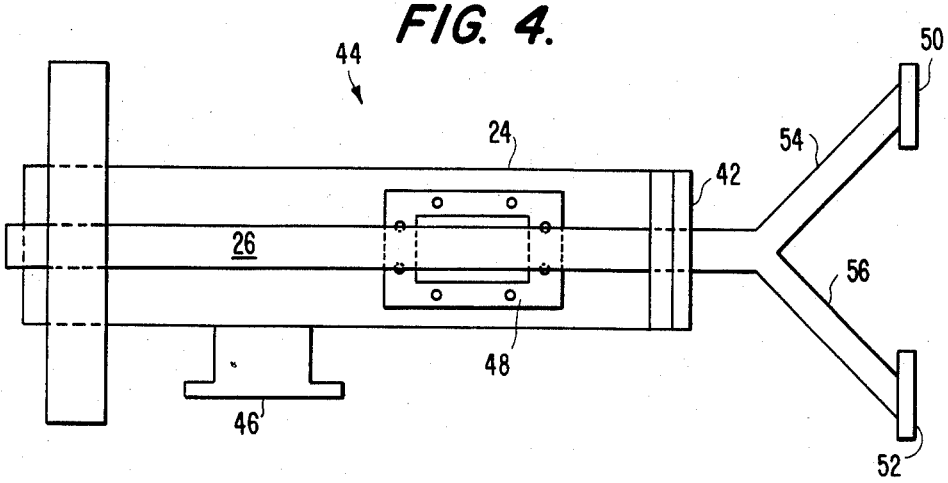
FIG. 4 is a perspective drawing of an alternate embodiment of the present invention.

FIG. 4 illustrates an optional waveguide configuration 44 which is used with the outer waveguide 24 and the inner waveguide 26. Instead of providing the vertical and horizontal waveguide ports on the same plane, FIG. 4 indicates that the waveguide ports 46 and 48 used with the outer waveguide 24 can be arranged 90° from one another and are provided in orthogonal planes.

The vertical and horizontal waveguide ports 50 and 52 which are used in conjunction with the inner high frequency waveguide 26 are joined to this waveguide utilizing transmission lines 54 and 56. This embodiment will be utilized instead of employing the series of diametric conducting pins which would be employed if the vertical and horizontal ports were provided in the same plane. These pins, although not shown, would be used in conjunction with the waveguide shown in FIG. 2.

The inner waveguide 26 will be supported by the end cap on the outer waveguide 24 at the closed end and by diametrically spaced pins within the lower frequency waveguide of FIG. 2 or by placing a low loss plastic to support the inner tube 26 a number of wavelengths near the opening of the outer waveguide 24 of FIG. 4.

It is to be understood that the above-described embodiments are simply illustrative of the principles of the present invention, and various other modifications and changes may be made by those skilled in the art which will embody the principles of the present invention and fall within the spirit and scope thereof.

What is claimed is:

1. A dual-feed waveguide used in conjunction with an antenna comprising:

a first circular waveguide or transmitting and receiving microwave energy therethrough at a first frequency band in the range of 3.7 to 4.2 GHz, the diameter of said first circular waveguide large enough to allow the microwave energy of said first frequency band to produce only lower modes $TE_{01}$, $TM_{01}$, said lower modes $TE_{01}$, $TM_{01}$, provided with a null area in the center of said first circular waveguide, and the diameter of said first circular waveguide small enough to contain the complete first frequency and without reaching the cut-off limit; and a second circular waveguide provided within said first circular waveguide and concentric therethrough at a second frequency receiving microwave energy therethrough at a second frequency band in the range between 9.0 and 15.0 GHz wherein the diameter of said second circular waveguide is less than the diameter of said first circular waveguide, and said diameter of said second circular waveguide is large enough to contain the complete second frequency band without reaching th cut-off limit, but small enough to be completely contained in the null area of the lower modes $TE_{01}$, $TM_{01}$, of the first frequency band.

2. The dual-feed waveguide in accordance with claim 1 wherein the end of said second circular waveguide closer to the antenna protrudes beyond the end of said first circular waveguide.

3. The dual-feed waveguide in accordance with claim 2 wherein the output of said first circular waveguide closer to the antenna is connected to a scalar feed network.

4. The dual-feed waveguide in accordance with claim 3 further including a first means for rotating said first circular waveguide and a second means for rotating said second circular waveguide.

5. The dual-feed waveguide in accordance with claim 1 further including a first means for rotating said first circular wavegude and a second means for rotating said second circular waveguide.

* * * * *